US008398419B2

(12) United States Patent
Coyle, Jr.

(10) Patent No.: US 8,398,419 B2
(45) Date of Patent: Mar. 19, 2013

(54) ELECTRICAL CONNECTORS FOR PHOTOVOLTAIC SYSTEMS

(75) Inventor: William J. Coyle, Jr., Toms River, NJ (US)

(73) Assignee: Heyco Inc., Toms River, NJ (US)

( * ) Notice: Subject to any disclaimer, the term of this patent is extended or adjusted under 35 U.S.C. 154(b) by 334 days.

(21) Appl. No.: 12/910,326

(22) Filed: Oct. 22, 2010

(65) Prior Publication Data

US 2011/0097917 A1 Apr. 28, 2011

Related U.S. Application Data

(60) Provisional application No. 61/254,770, filed on Oct. 26, 2009.

(51) Int. Cl.
*H01R 13/52* (2006.01)

(52) U.S. Cl. ..... 439/275

(58) Field of Classification Search ..... 439/273, 439/272, 283, 460–462, 275
See application file for complete search history.

(56) References Cited

U.S. PATENT DOCUMENTS

| | | | | |
|---|---|---|---|---|
| 4,090,759 | A * | 5/1978 | Herrmann, Jr. | 439/281 |
| 4,601,528 | A * | 7/1986 | Spier | 439/277 |
| 5,131,864 | A | 7/1992 | Van Zeelst et al. | |
| 6,203,354 | B1 | 3/2001 | Kuwahara et al. | |
| 6,296,508 | B1 | 10/2001 | Kuwahara et al. | |
| 6,336,821 | B1 | 1/2002 | Hattori | |
| 6,409,532 | B2 * | 6/2002 | Payson et al. | 439/462 |
| 6,709,289 | B2 | 3/2004 | Huber et al. | |
| 7,070,458 | B2 * | 7/2006 | Axenbock et al. | 439/272 |
| 7,318,758 | B2 | 1/2008 | Haller | |
| 8,241,051 | B2 * | 8/2012 | Yi et al. | 439/271 |
| 2006/0270262 | A1 * | 11/2006 | Schmidt et al. | 439/271 |

FOREIGN PATENT DOCUMENTS

| | | |
|---|---|---|
| EP | 0570650 | 11/1993 |
| JP | 2001283970 | 10/2001 |
| JP | 2001338732 | 12/2001 |
| JP | 2002009326 | 1/2002 |

* cited by examiner

*Primary Examiner* — Felix O Figueroa
(74) *Attorney, Agent, or Firm* — Greenberg Traurig, LLP.

(57) ABSTRACT

An electrical connector system including first and second electrical connector members mated to one another to form a sealed connection in order to protect electrically-conductive components against the infiltration of moisture. The first connector member includes a socket with a first annular ridge at its tip, while a second annular ridge is formed within the socket at its base. An electrically-conductive pin is housed within the first connector member and extends into the interior of the socket. The second connector member includes a plug. An electrically-conductive socket, mated to the pin, is housed within the plug. When the plug of the second connector member is mated with the socket of the first connector member, the tip of the plug contacts the annular ridge at the base of the socket, which is deformed so as to form a water-tight seal between the tip of the plug and the base of the socket. Likewise, the annular ridge at the tip of the socket contacts the base of the recess and is deformed so as to form another water-tight seal between the tip of the socket and the base of the recess.

10 Claims, 10 Drawing Sheets

ELECTRICAL CONNECTORS FOR PHOTOVOLTAIC SYSTEMS

CROSS-REFERENCE TO RELATED APPLICATION

This application is a Section 111(a) application relating to commonly owned, co-pending U.S. Provisional Patent Application No. 61/254,770, entitled ELECTRICAL CONNECTORS FOR PHOTOVOLTAIC SYSTEMS, filed on Oct. 26, 2009, the disclosure of which is incorporated by reference herein.

FIELD OF THE INVENTION

The disclosed subject matter relates to electrical connectors and, more particularly, electrical connectors for use in connection with photovoltaic systems.

BACKGROUND OF THE INVENTION

There is a growing need for renewable energy sources, with solar energy being at the forefront. As a result, the use of photovoltaic systems has increased exponentially in recent years. Electrical connectors are an integral part of a photovoltaic system, as they provide the necessary electrical connections between individual solar panels (i.e., photovoltaic modules) of a solar array, typically via electrical junction boxes, and between the solar panels and other system components (e.g., DC/AC inverters, etc.). Consequently, the reliability of the electrical connectors is crucial for maintaining a dependable and efficient photovoltaic system.

Current electrical connectors do not provide reliable electrical connections and their durability is low. In this regard, current electrical connectors are not sufficiently water-tight in that moisture may intrude, thereby damaging the electrical conductive components, or presenting a shock hazard among other undesirable consequences. What is needed, therefore, is a water-tight electrical connector that is easily installable, yet maintains a good electrical connection between the components of a photovoltaic system, and is reliable enough to withstand a wide range of environmental conditions.

SUMMARY OF THE INVENTION

The disclosed subject matter can overcome the disadvantages and shortcomings discussed above by providing an electrical connector system that includes first and second electrical connectors that are mated to one another to form a sealed connection in order to protect electrically-conductive components against the infiltration of moisture. More particularly, the first connector member includes an outer collar and a socket that extends past the collar. The socket includes a first annular ridge at its tip. A second annular ridge is present within the socket at its base. An electrically-conductive pin is housed within the first connector and extends into the interior of the socket. A second connector member includes an outer collar, a projecting plug within the collar, and an annular recess between the outer collar and the plug. An electrically-conductive socket, mated to the pin, is housed within the plug.

Both the inner wall of the socket of the first connector member and the outer wall of the plug of the second connector member are closely mated to each other and have smooth, generally conical and tapered surfaces to allow easy and complete insertion of the plug into the socket and separation thereof. When the plug of the second connector member has been completely inserted into the socket of the first connector member, the tip of the plug contacts (or at least is within close proximity to) the annular ring at the base of the socket, which is deformed so as to form a water-tight seal between the tip of the plug and the base of the socket. Likewise, the annular ring at the tip of the socket contacts (or at least is within close proximity to) the base of the recess and is deformed so as to form another water-tight seal between the tip of the socket and the base of the recess. These water-tight seals protect the electrically conductive components from moisture infiltration when the first and second connector members are mated with one another. A resilient deformable material or other sealing material, or an auxiliary seal, such as an o-ring, may also be used to add to the sealing effect.

A locking mechanism can be provided that locks the first and second connector members together when the plug of the second connector member is completely inserted into the socket of the first connector member, so as to insure the efficacy of the sealing effect. Specifically, the first connector member includes locking windows penetrating its outer collar, and the second connector member includes flexible locking tabs formed in its outer collar. The windows and tabs are arranged such that each tab engages with a respective window only when the plug has been completely inserted into the socket. In the locked configuration, each tab is recessed into its respective window, such that a tool is required to disengage it. As a result, the first and second connector members are prevented from any significant rotation with respect to each other, which might cause internally formed seals to be non-sealing.

Each of the first and second connector members can also include a liquid-tight fitting at the end thereof opposite its mated end. Specifically, the liquid-tight fitting can comprise a gland and gripping fingers that create redundant liquid seals, when a locking nut is tightened on the respective first or second connector member. This can cause the gripping fingers to deform the gland into sealing engagement with the cable of an electrical conductor inserted into the respective first and second connector members.

Specifically, the present invention has been adapted for use in connection with photovoltaic systems. However, the present invention can be utilized in connection with other power generating systems. Further features and advantages of the invention will appear more clearly on a reading of the following detailed description of the exemplary embodiments of the invention.

BRIEF DESCRIPTION OF THE DRAWINGS

Reference is made to the following detailed description of the exemplary embodiment considered in conjunction with the accompanying drawings, in which.

DETAILED DESCRIPTION OF THE EXEMPLARY EMBODIMENTS

Figure 1:
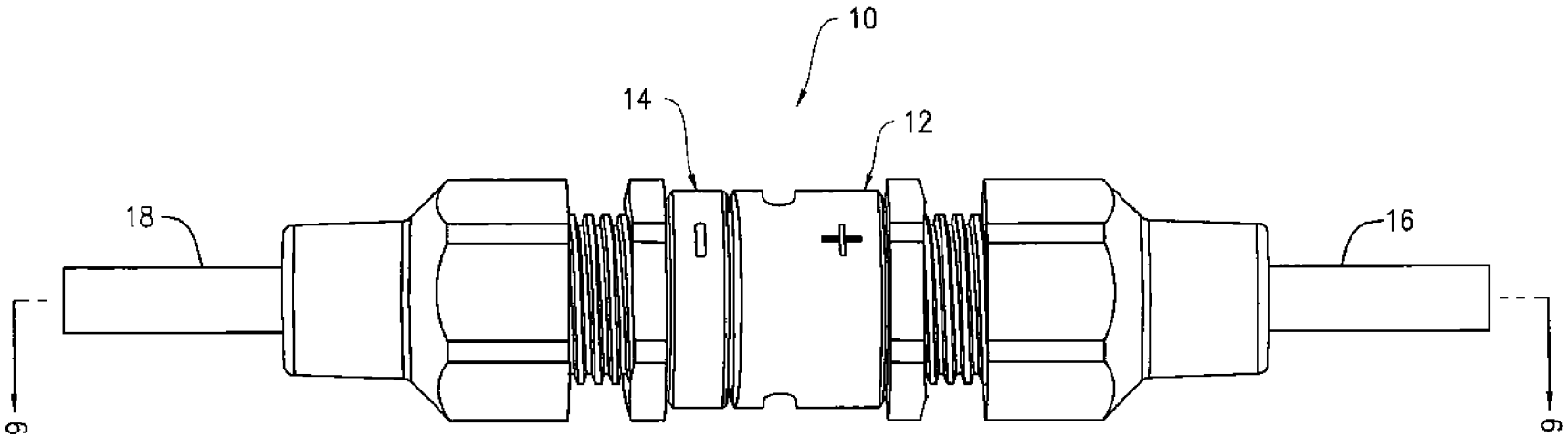
FIG. 1 is a top plan view of an electrical connector system constructed in accordance with an exemplary embodiment of the present invention.

Referring to FIG. 1, an electrical connector system 10 includes a first connector member 12 and a second connector member 14 releasably mated with the first connector member 12. The first connector member 12 is attached to a first electrical conductor 16, such as a first electrical wire, while the second connector member 14 is attached to a second electrical conductor 18, such as a second electrical wire. When mated, the first and second connector members 12, 14 provide a physical and an electrical connection between the first and second electrical conductors 16, 18.

The first and second connector members 12, 14 can be manufactured from a thermoplastic polymer, such as polycarbonate. Alternatively, the first and second connector members 12, 14 may be manufactured from any other suitable materials known in the art, especially materials having electrical insulating properties and adequate flexibility, and the materials can be supplied by other manufacturers. Each of the first and second connector members 12, 14 is described in more detail below.

Figures 2A, 3:
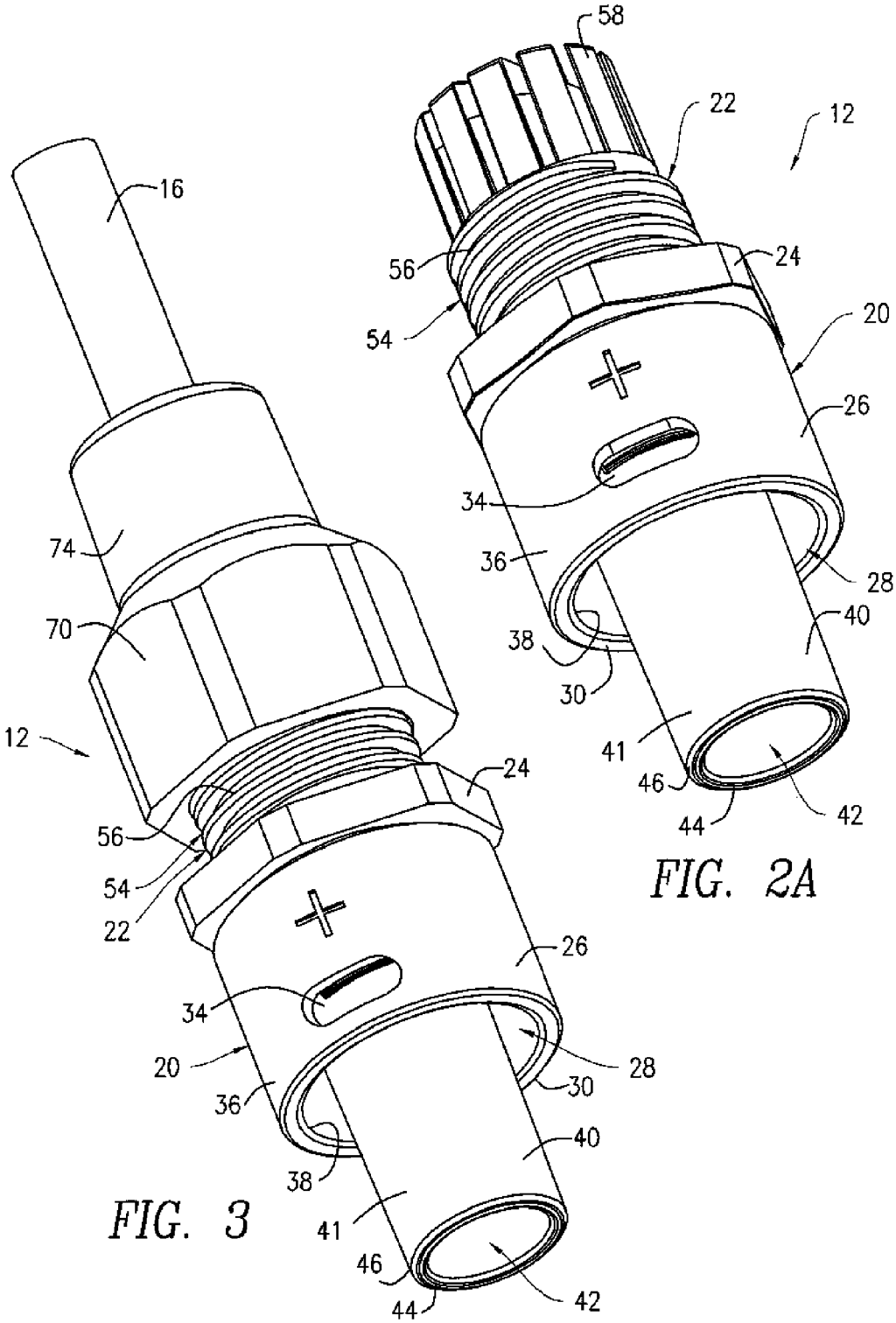
FIG. 2A is a top perspective view of a first connector employed by the electrical connector system shown in system shown in FIG. 1.
FIG. 3 is a perspective view of the first connector shown in FIG. 2A including an associated liquid tight fitting portion crimped on a first conductor.
Figure 2B:
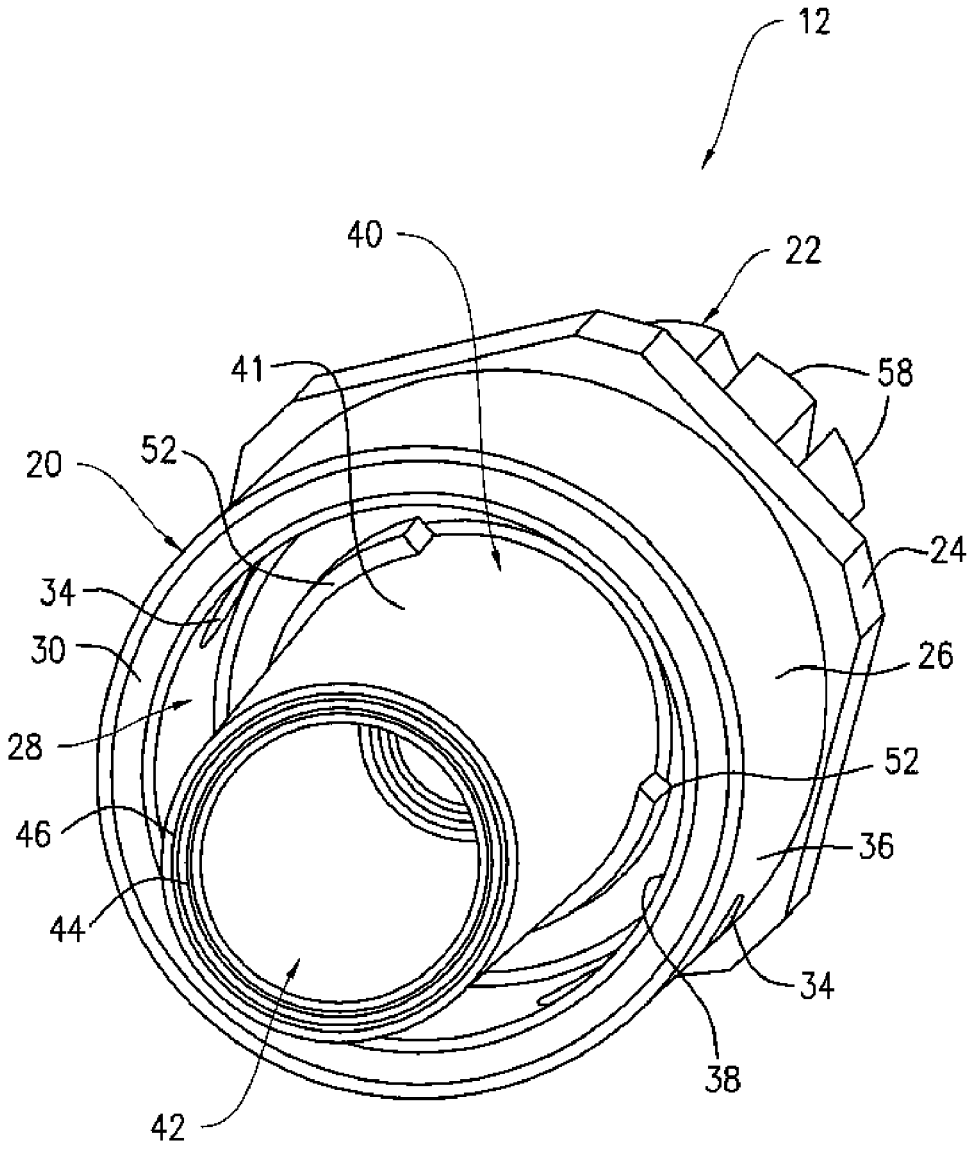
FIG. 2B is a front perspective view of the first connector shown in FIG. 2A.

Referring to FIGS. 2A and 2B, the first connector member 12 includes a mating portion 20 and a liquid-tight fitting portion 22 opposite the mating portion 20. The mating portion 20 includes hexagonal-shaped flange 24 and a tubular-shaped outer collar 26 extending from the flange 24 in a first direction. The collar 26 includes a circular-shaped aperture 28 extending from one end 30 of the collar 26 to a base 32 of the collar 26 (the base 32 being shown in FIG. 6).

The collar 26 further includes a pair of diametrically opposed, oblong-shaped locking windows 34 (one of which is shown in FIG. 2A), each of which extends from an outer surface 36 of the collar 26 to an inner surface 38 of the collar 26. The purpose and function of the locking windows 34 is described hereinafter. A centrally located, generally conical-shaped socket 40 is positioned within the aperture 28 of the collar 26 and extends from the base 32 of the collar 26 and past the end 30 of the collar 26. The socket 40 includes a smooth, generally conical-shaped outer wall surface 41, a centrally located, circular-shaped receiving opening 42, and a first annular ridge 44 at its tip 46 (see also FIG. 7B).

Figure 7A:
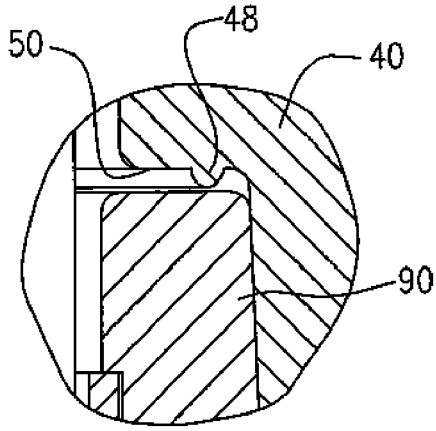
FIGS. 7A through 7C are enlarged, cross-sectional views showing details 7A through 7C, respectively, from FIG. 6.
Figure 7B:
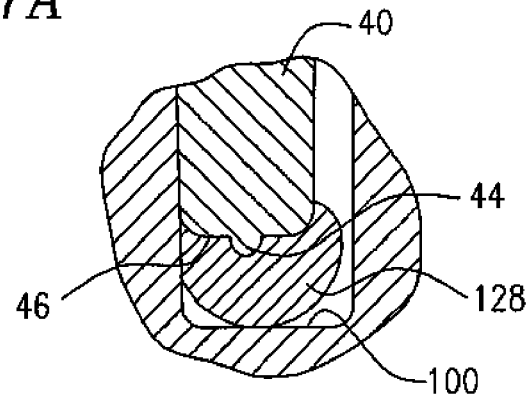
Figure 7C:
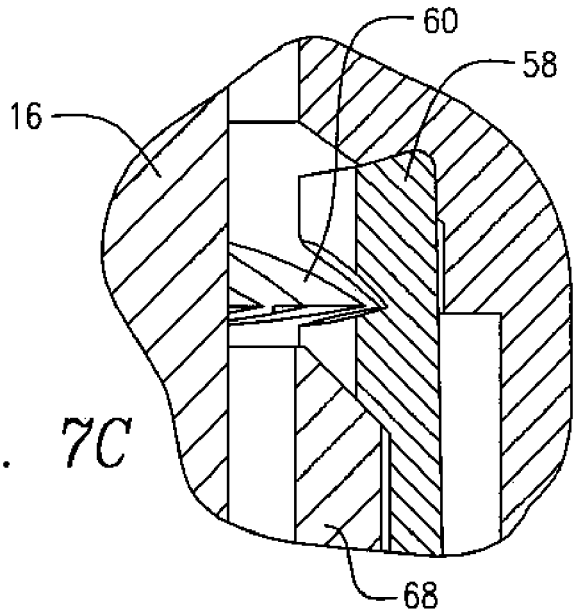

A second annular ridge 48 is present within the socket at its base 50 (not shown in FIGS. 2A and 2B, but see FIG. 7A). The first and second annular ridges 44, 48 are deformable, and their purpose and function is described hereinafter. Referring specifically to FIG. 2B, the outer wall surface 41 of the socket 40 includes a plurality of arc-shaped bosses 52 extending therefrom and circumferentially thereon. The purpose and function of the bosses 52 is described hereinafter. While the socket 40 includes two of the bosses 52, it may include more or less than two of the bosses 52.

Figure 2C:
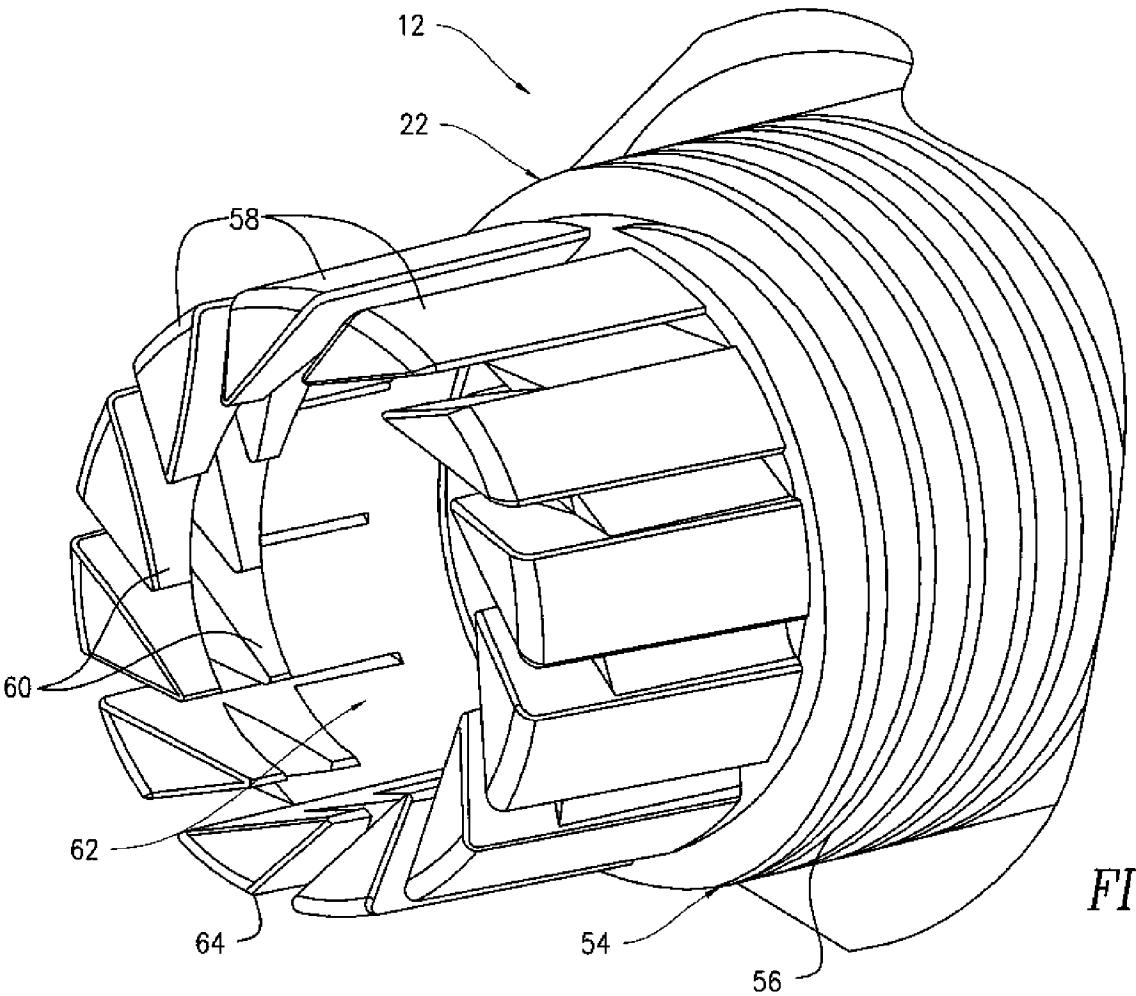
FIG. 2C is a partial, rear perspective view of the first connector shown in FIG. 2A.

Referring to FIGS. 2A, 2C and 3, the liquid tight fitting portion 22 of the first connector 12 is, preferably, similar in overall structure and function to the liquid-tight fittings shown and described in U.S. Pat. Nos. 6,300,569; 5,872,335; and 5,405,172 assigned to the assignee herein, such patents being incorporated by reference herein for their teachings concerning the configuration and manufacture of liquid tight fittings. In general, the liquid tight fitting portion 22 includes a tubular-shaped threaded portion 54 having external threads 56, and a plurality of flexible fingers 58 arranged in an annular pattern (see FIGS. 2A and 2C) and extending in an axial direction from the threaded portion 54. The fingers 58 include a plurality of teeth 60 arranged in double rows (see FIG. 2C), and whose purpose is be described hereinbelow. While each of the fingers 58 includes two of the teeth 60, each of the fingers 58 may include more or less than two of the teeth 60. A centrally located aperture 62 extends from an end 64 of the liquid tight fitting portion 22 and through the threaded portion 54 and mating portion 20 and converges with the opening 42 of the socket 40 (see FIG. 6).

Figure 6:
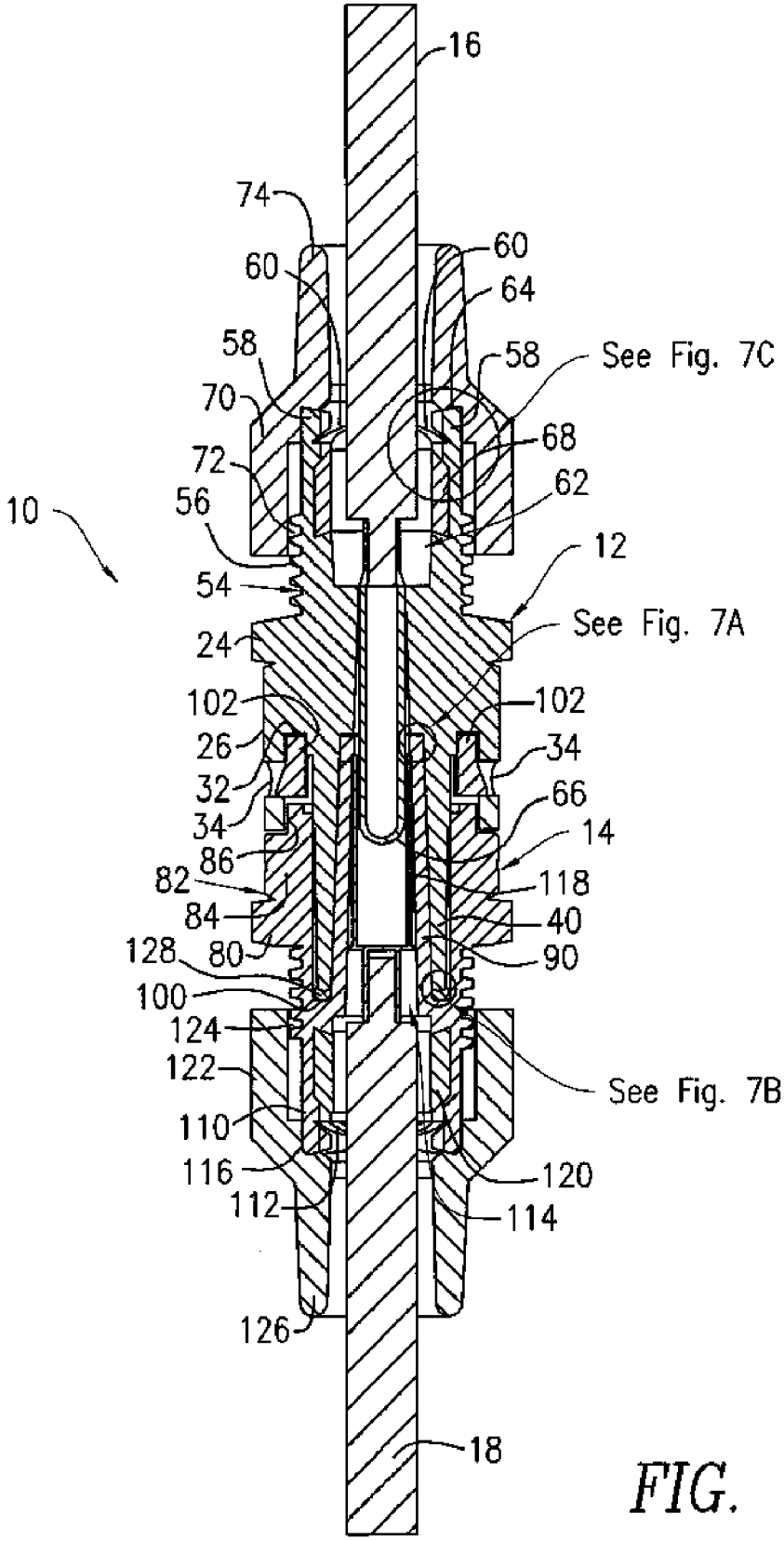
FIG. 6 is a cross-sectional view, taken along section line 6-6 and looking in the direction of the arrows, of the electrical connector system shown in FIG. 1.

Referring to FIG. 6, the first conductor 16 includes an electrically conductive pin 66 received within the aperture 62 of the first connector 12 and extends through the opening 42 of the socket 40. A gland 68 of deformable sealing material is embraced by the fingers 58 and assists in forming a fluid tight seal against a portion of the conductor 16 held in the liquid tight fitting portion 22. A sealing nut 70 having internal threads 72 threadedly engages the threads 56 of the threaded portion 54 and, upon tightening, a generally conically shaped inner surface thereof (not shown in the Figures) abuts against and urges the fingers 58 inwardly to crimp on the first conductor 16. The flange 24 enables one to use a tool (such as a wrench) to facilitate the tightening and loosening of the sealing nut 70. The teeth 60 increase the retaining capability of the liquid tight fitting portion 22 on the conductor 16, resulting in a much stronger strain relief. The sealing nut 70 includes an extended nose 74 for additional creepage length. Alternatively, the nose 74 need not be included.

Figure 4A:
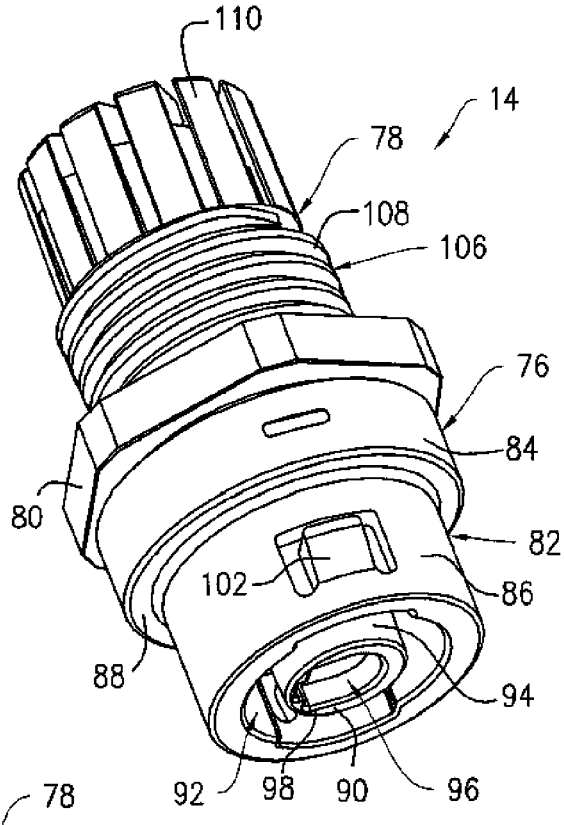
FIG. 4A is a top perspective view of a second connector employed by the electrical connector system shown in FIG. 1.
Figure 4B:
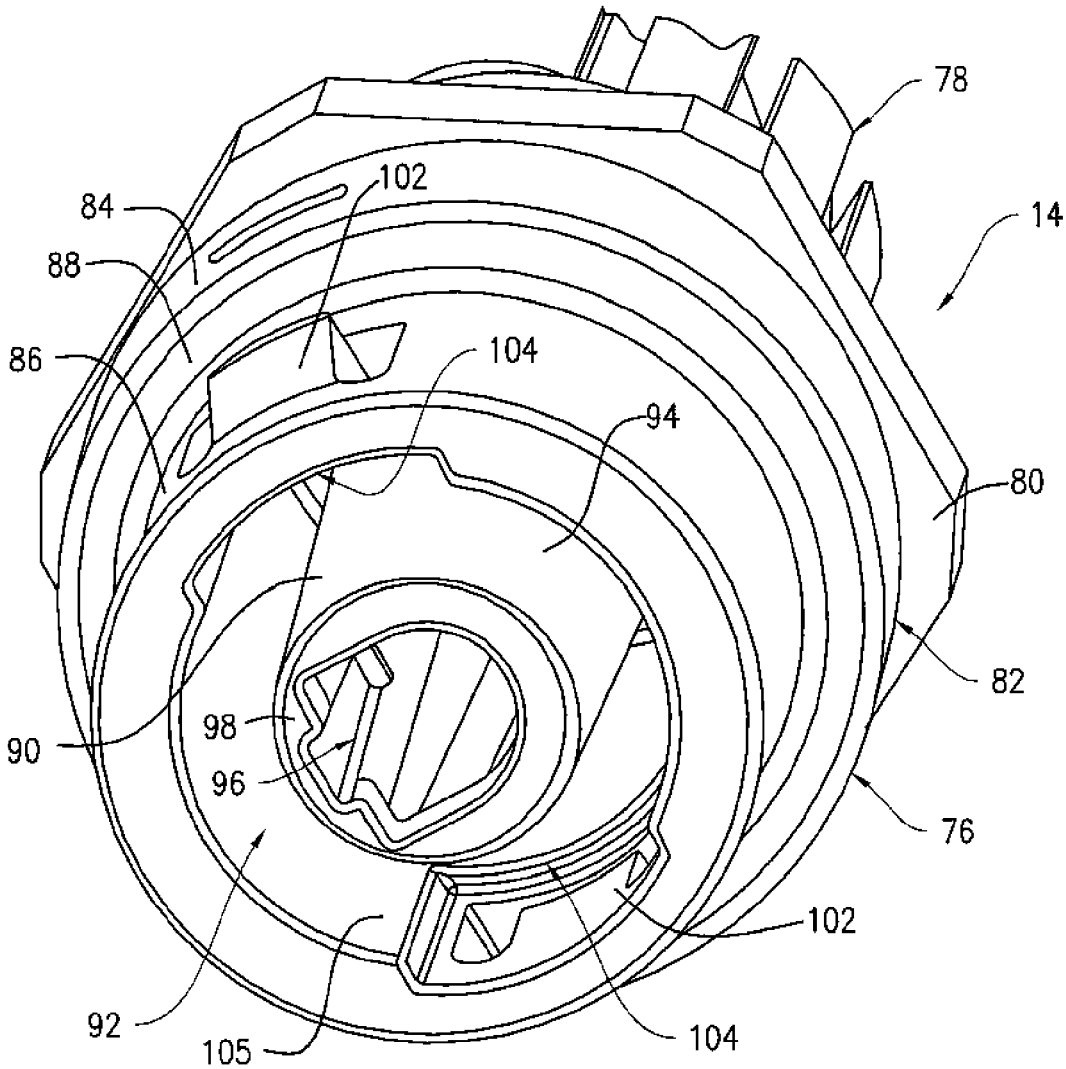
FIG. 4B is a partial, rear perspective view of the second connector shown in FIG. 4A.

Referring to FIGS. 4A and 4B, the second connector 14 includes a mating portion 76 and a liquid tight fitting portion 78 opposite the mating portion 76. The mating portion 76 includes a hexagonal-shaped flange 80 and an outer collar 82 extending therefrom. The outer collar 82 includes a first collar section 84 and a second collar section 86 which cooperate to form a ledge 88. A projecting plug 90 is formed within the second collar portion 86 and an annular recess or opening 92 is positioned between the plug 90 and the second collar portion 86.

The plug 90 includes a smooth, generally conical-shaped exterior surface 94 and a centrally located aperture 96 extending from a tip 98 of the plug 90 to a base 100 of the opening 92 (see FIG. 6). The second collar portion 86 includes a pair of diametrically opposed, flexible locking tabs 102 formed therein. The purpose and function of the locking tabs 102 shall be described hereinafter. A plurality of arc-shaped slots 104 are formed circumferentially within an interior surface 105 of the plug 90. While the plug 90 includes two of the slots 104, it may include more or less than two of the slots 104. The purpose and function of the slots 104 shall be described hereinafter.

Figure 5:
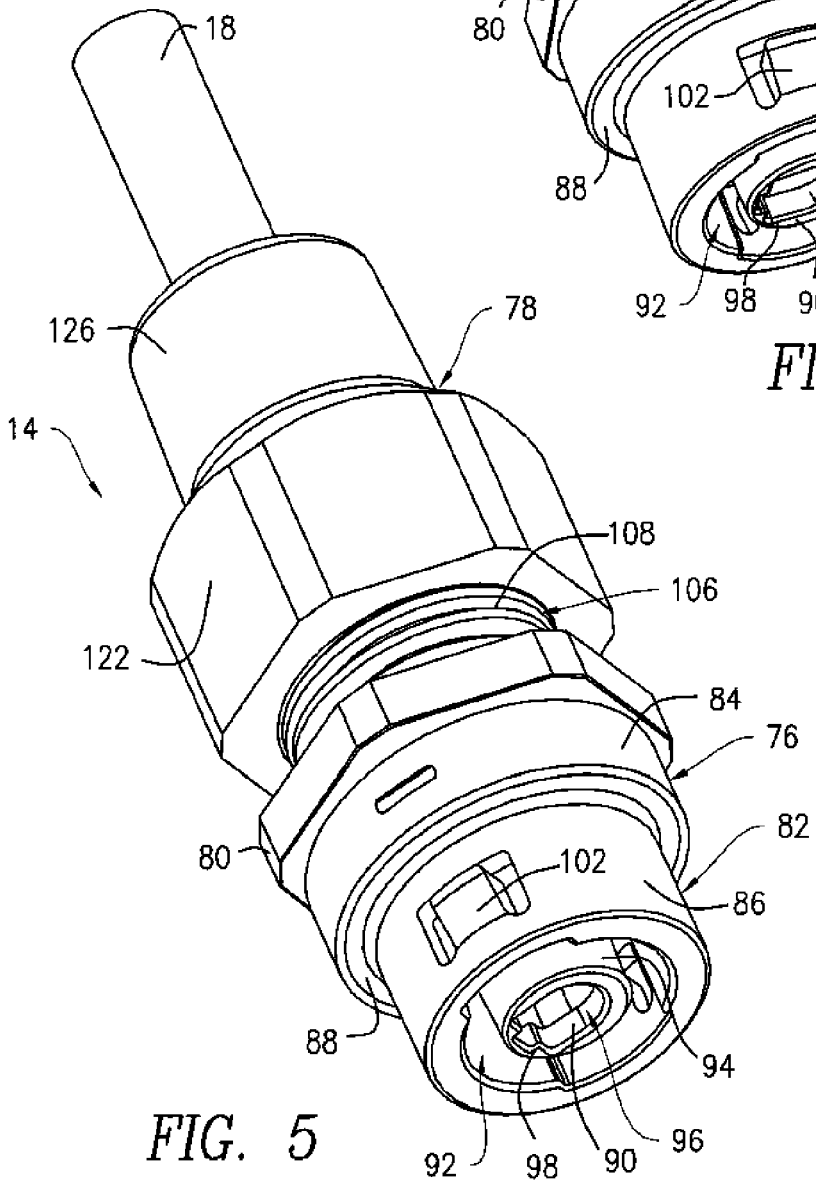
FIG. 5 is a perspective view of the second connector shown in FIG. 4A including an associated liquid tight fitting portion crimped on a second conductor.

Referring to FIGS. 4A and 5, the liquid tight fitting portion 78 of the second connector 14 is similar in structure and function to the liquid tight fitting portion 22 of the first connector 12 described above. That is, the liquid tight fitting portion 78 includes a tubular-shaped threaded portion 106 having external threads 108, and a plurality of flexible fingers 110 arranged in an annular pattern and extending in an axial direction from the threaded portion 106. The fingers 110 include a plurality of teeth 112 arranged in double rows (which have a structure and an arrangement similar to those of the teeth shown in FIG. 2C; see also FIG. 6), and whose purpose shall be described hereinbelow. While each of the fingers 110 includes two of the teeth 112, each of the fingers 110 may include more or less than two of the teeth 112. A centrally located aperture 114 extends from an end 116 of the fitting portion 78 and through the threaded portion 106 and mating portion, and converges with the aperture 96 of the plug 90 (see FIG. 6).

Referring to FIG. 6, the conductor 18 includes an electrically conductive socket 118 received by the aperture 114 of the second connector member 14 and extends into the aperture 96 of the plug 90. A gland 120 of deformable sealing material is embraced by the fingers 110 and assists in forming a fluid tight seal against the conductor 18 held in the fitting portion 78. A sealing nut 122 having internal threads 124 threadedly engages the external threads 108 of the threaded portion 106 of the fitting portion 78 and, upon tightening, an inner surface thereof (not shown in the Figures) abuts against and urges the fingers 110 inwardly to crimp on the conductor 18. The flange 80 enables a user to use a tool (such as a wrench) to facilitate the tightening and loosening of the sealing nut 122. The teeth 112 of the fingers 110 increase the retaining capability of the liquid tight fitting portion 78 on the conductor 18, resulting in a much stronger strain relief. The sealing nut 122 includes an extended nose 126 for additional creepage length. Alternatively, the nose 126 need not be included.

Referring to FIGS. 6 and 7A-7C, the first and second connector members 12, 14 are releasably connected to one another by inserting the socket 40 of the first connector member 12 into the plug 90 of the second connector member 14. Since the interior surface 41 of the socket 40 and the exterior surface 94 of the plug 90 are closely mated to each other and have smooth, generally conical surfaces, they allow easy and complete insertion of the plug 90 into the socket 40. In this manner, the socket 118 is mated with the pin 66. When the plug 90 has been completely inserted into the socket 40, the end 30 of the collar 26 of the first connector 12 is juxtaposed with the ledge 88 of the second connector member 14. As a result, the tip 98 of the plug 90 contacts the annular ridge 48 at the base 50 of the socket 40, which is deformed so as to form a water-tight seal between the tip 98 of the plug 90 and the base 50 of the socket 40.

The annular ridge 44 at the tip 46 of the socket 40 contacts the base 100 of the opening 92 and is deformed so as to form another water tight seal between the tip 46 of the socket 40 and the base 100 of the opening 92. Accordingly, seals against infiltration of moisture are created by applying pressure on the annular ridges 44, 48 at the tip 46 and the base 50 of the socket 40 in contact with the second connector 14. As a result, the electrically-conductive components (i.e., the pin 66 and the socket 118) are protected from moisture. In addition, an O-ring 128 is preferably positioned between the tip 46 of the socket 40 and the base 100 of the opening 92 to enhance the water tight seal between the tip 46 of the socket 40 and the base 100 of the opening 92 (see FIG. 7B). Alternatively, the O-ring 128 need not be included. The liquid-tight fittings 22, 78 create redundant liquid seals along the conductors 16, 18, respectively, which further enhance the moisture resistance of the connector 10.

The windows 34 and tabs 102 are arranged and sized and shaped such that each tab 102 engages a respective window 34 only when the plug 90 has been completely inserted into the socket 40. In the locked configuration, each tab 102 is recessed into its corresponding window 34 such that a tool is required to disengage it. Also, in the locked configuration, each of the bosses 52 is sized and shaped to engage a corresponding one of the slots 104, so as to prevent rotation of the first connector 12 relative to the second connector 14, and vice-versa. Accordingly, the first and second connectors 12, 14 are firmly connected to one another. When the tabs 102 are disengaged, the smooth, generally conical surfaces of the socket 40 and the plug 90 allow for easy separation of the connectors 12, 14 from one another.

As indicated above, the electrical conductors 16, 18 serve as the positive and negative connections and, in turn, may be connected electrically to electrical devices of a photovoltaic system, DC/AC power inverters junction boxes other connectors, etc. (not shown in the Figures).

Figure 8:
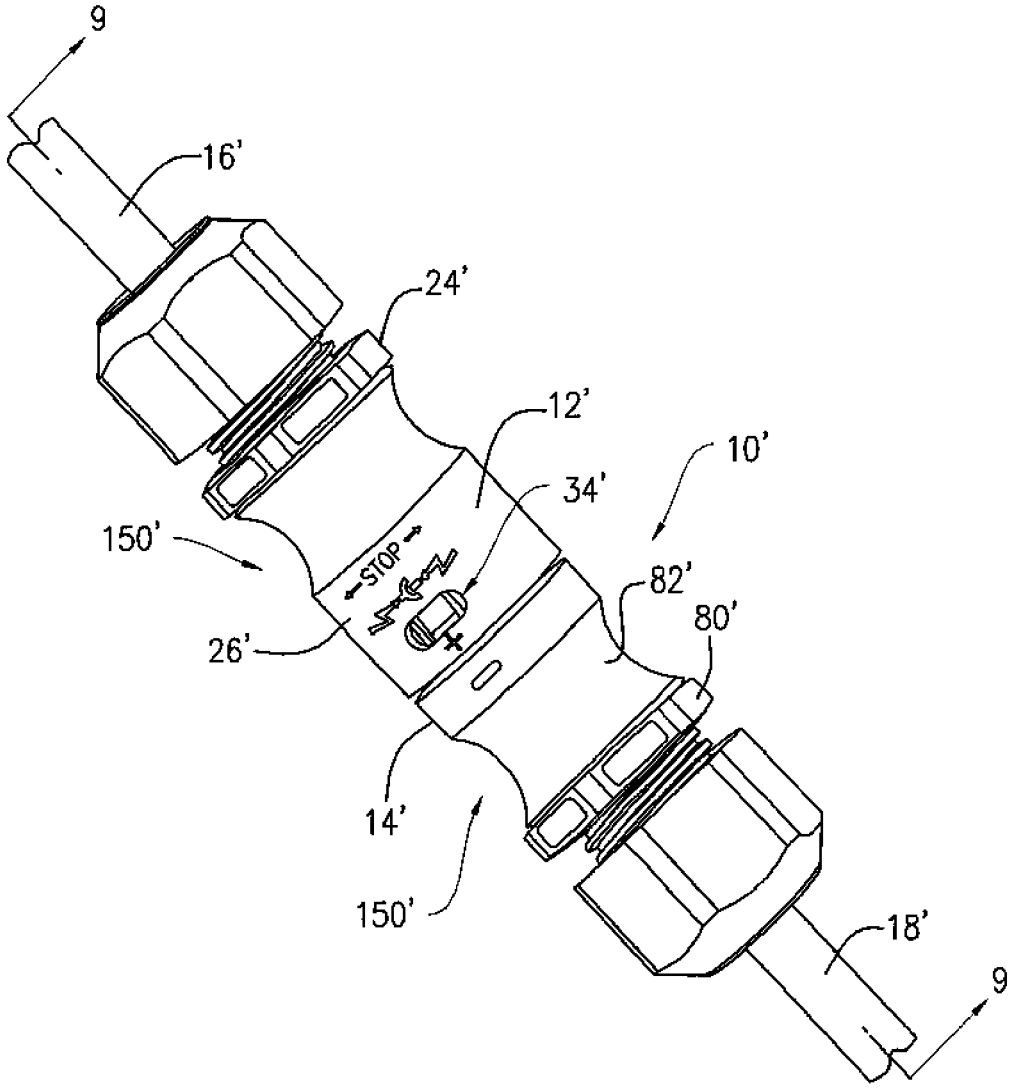
FIG. 8 is a perspective view of another embodiment of an electrical connector system constructed in accordance with an exemplary embodiment of the present invention; and, FIG. 9 is a cross-sectional view of the embodiment of FIG. 8 along lines 9-9.
Figure 9:
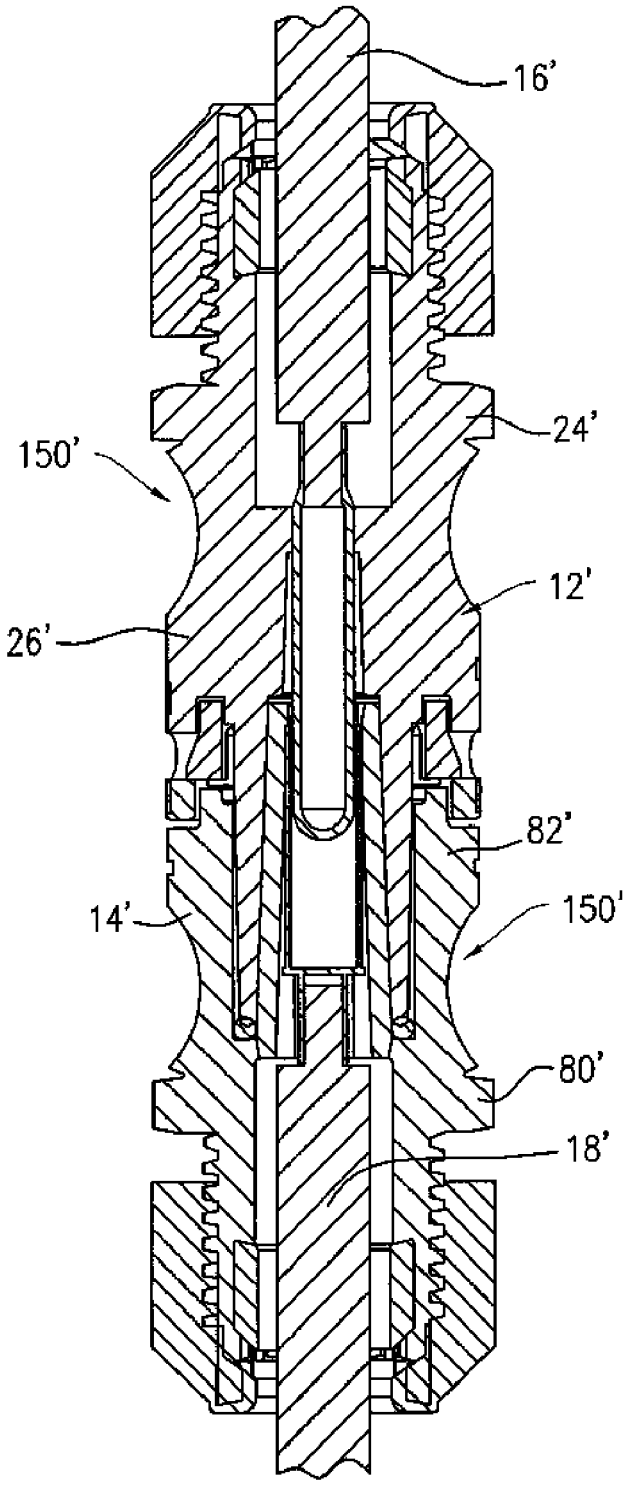

Turning now to FIGS. 8 and 9, there is illustrated by way of example another embodiment of an electrical connector system 10'. This embodiment of the electrical connector system 10' includes a first connector member 12' and a second connector member 14' releasably mated with the first connector member 12'. The first connector 12' is attached to a first electrical conductor 16', such as a first electrical wire, while the second connector 14' is attached to a second electrical conductor 18', such as a second electrical wire. When mated, the first and second connector members 12', 14' provide a physical and an electrical connection between the first and second conductors 16', 18'.

The first connector member 12' includes a hexagonal-shaped flange 24' and a tubular-shaped outer collar 26' extending from the flange 24' in a first direction. The collar 26' further includes a pair of diametrically opposed, oblong-shaped locking windows 34' (one of which is shown in FIG. 8). The second connector member 14' includes a hexagonal-shaped flange 80 and an outer collar 82' extending therefrom. The outer collars 26' and 82' each include an annular recess 150' which can receive an operator's finger, e.g., the thumb of each hand, respectively, to facilitate the mating and un-mating of the first connector member 12' with the second connector member 14'.

It will be understood that the electrical connectors 10, 10' described herein are merely exemplary and that a person skilled in the art may make many variations and modifications without departing from the full spirit and the scope of the embodiments described herein. For example, the size and shape of the first and second connectors 12, 14 can be varied to accommodate electrical conductors having sizes and shapes different from those of the conductors 16, 18. In addition, while the first connector member 12 includes the two windows 34, and the second connector member 14 includes the two tabs 102, they can include more or less than two of each. Furthermore, the tabs 102 and the windows 34 can consist of different shapes and sizes known in the art. Alternatively, the tabs 102 and the windows 34 need not be included and the first and second connectors 12, 14 may be attached to one another by other means known in the art (e.g., threads, adhesives, etc.). In addition, as indicated above, while the first connector 12 includes two of the bosses 52 and the second connector 14 includes two of the slots 104, they can include more or less than two of each. Finally, while each of the fingers 58 includes two of the teeth 60, and each of the fingers 110 includes two of the teeth 112, they each may include more or less than two. Accordingly, all such variations and modifications are intended to be included within the scope of the present invention.

What is claimed is:

1. An electrical connector system, comprising:

a first connector member and a second connector member releasably mateable to each other;

the first connector member being connected to one end of a first electrical wire having a first terminal conductor end and the second connector member being connected to one end of a second electrical wire having a second terminal conductor end;

the first connector member having a base portion with a socket extending from one side, the socket having an internal hollow defined by a wall having a smooth truncated cone shape, the first terminal conductor end disposed in the internal hollow;

the second connector member having a plug with a side wall defining an internal hollow and having a smooth exterior surface with a truncated cone shape, complementary to the internal hollow of the socket, the second connector member having a peripheral collar disposed around the plug and spaced therefrom, defining an annular recess around the plug, the second terminal conductor end disposed in the internal hollow of the plug;

when mated, the first connector member and the second connector member capable of providing an electrical connection between the first and second electrical wires, with the plug of the second connector member matingly and slideably received in the internal hollow of the socket of the first connector member, and at least a portion of the first connector member socket received in the annular recess of the second connector member with the first and second terminal conductor ends in electrical contact;

the socket of the first connector member having a tip distal to the base portion and a base proximate to the base portion;

the first connector member and the second connector member each having a liquid tight fitting portion with a threaded section distal to the socket and plug, respectively, the liquid tight portion housing at least one deformable sealing member, and a respective sealing nut threadedly engaging the respective threaded section and adapted to deform the deformable member into engagement with the respective first and second electrical wires when tightened on the respective threaded sections to seal against the first and second electrical wires, respectively, the socket formed monolithically with the base portion and the threaded section of the first connector member, and the plug formed monolithically with the collar and the threaded section of the second connector member;

a first sealing mechanism formed proximate the base of the socket of the first connector member interior to the internal hollow thereof; and a second sealing mechanism, discrete from the first sealing mechanism, formed on the tip of the socket.

2. The electrical connector system of claim 1, wherein the sealing mechanism of the tip is formed by an annular protrusion and an O-ring.

3. The electrical connector system of claim 1, wherein the first sealing mechanism is formed by a first annular protrusion.

4. The electrical connector system of claim 3,wherein the second sealing mechanism is formed by a second annular protrusion.

5. The electrical connector system of claim 4, wherein at least one of the first and second annular protrusions each comprise a flexible sealing material.

6. The electrical connector system of claim 1, wherein the first connector member includes a first locking mechanism, and the second connector member includes a second locking mechanism adapted to engage the first locking mechanism, the first and second locking mechanisms, when in engagement, preventing the first connector member from separating from the second connector member.

7. The electrical connector system of claim 6, wherein the first locking mechanism includes at least one locking window, and the second connector member includes at least one locking tab.

8. The electrical connector system of claim 7, wherein the at least one locking window and the at least one locking tab are arranged such that the at least one tab engages with the respective at least one locking window when the plug of the second connector member has been completely inserted into the socket of the first connector member.

9. The electrical connector system of claim 1, wherein the first connector member includes a peripheral collar disposed around the socket defining an annular recess therebetween.

10. The electrical connector system of claim 1, wherein an outer side wall of the socket includes at least one boss extending therefrom and an interior surface of the collar of the second connector member includes at least one slot formed therein, the at least one boss sized and shaped to engage the at least one slot to prevent rotation of the first connector member relative to the second connector member.

* * * * *